US011103070B2

(12) United States Patent
Benesch

(10) Patent No.: US 11,103,070 B2
(45) Date of Patent: Aug. 31, 2021

(54) CHAIR SUPPORT DEVICE PRIMARILY FOR OFFICE USE

(71) Applicant: Ferenc Benesch, Budapest (HU)

(72) Inventor: Ferenc Benesch, Budapest (HU)

( * ) Notice: Subject to any disclaimer, the term of this patent is extended or adjusted under 35 U.S.C. 154(b) by 0 days.

(21) Appl. No.: 17/057,217

(22) PCT Filed: Dec. 18, 2019

(86) PCT No.: PCT/HU2019/050057
§ 371 (c)(1),
(2) Date: Nov. 20, 2020

(87) PCT Pub. No.: WO2020/128544
PCT Pub. Date: Jun. 25, 2020

(65) Prior Publication Data

US 2021/0212468 A1 Jul. 15, 2021

(30) Foreign Application Priority Data

Dec. 21, 2018 (HU) ..... P1800441

(51) Int. Cl.
*A47C 7/14* (2006.01)
*A47C 3/026* (2006.01)
(Continued)

(52) U.S. Cl.
CPC ..... *A47C 3/026* (2013.01); *A47C 3/18* (2013.01); *A47C 7/004* (2013.01); *A47C 7/144* (2018.08)

(58) Field of Classification Search
CPC ..... A47C 3/026; A47C 3/18; A47C 7/144; A47C 7/004
See application file for complete search history.

(56) References Cited

U.S. PATENT DOCUMENTS 2,048,148 A * 7/1936 Stoll ..... A47C 3/0252 248/583
4,099,697 A * 7/1978 Von Schuckmann .. A47C 3/026 248/398

(Continued)

FOREIGN PATENT DOCUMENTS

CN 204363462 U 6/2015
DE 4210135 A1 9/1993

(Continued)

OTHER PUBLICATIONS

International Search Report for PCT/HU2019/050057 dated Mar. 30, 2020, in English (2 pages).

(Continued)

*Primary Examiner* — Philip F Gabler
(74) *Attorney, Agent, or Firm* — Fitch, Even, Tabin & Flannery, LLP

(57) ABSTRACT

A chair support device primarily for office use includes a lower support having rollers or feet for standing on the floor spaced apart from each other in predetermined distances, an upper support, and a receiving tube, as a support member, that has a central axis, connected to a central portion of the upper support, extends therefrom towards the lower support and is coupled to a central portion of the lower support by a ball joint that enables tilting of the receiving tube within an angular range relative to vertical and weight load to be taken predominately by the lower support. The support member is preferably in or close to the weight line of a chair held by the device.

10 Claims, 6 Drawing Sheets

(51) Int. Cl.
*A47C 3/18* (2006.01)
*A47C 7/00* (2006.01)

(56) References Cited

U.S. PATENT DOCUMENTS 5,570,929 A 11/1996 Glockl
6,601,818 B1 * 8/2003 Larsen ..... A47C 3/0255 248/621
6,688,689 B1 * 2/2004 Thorn ..... A47C 7/14 297/314
8,075,056 B2 * 12/2011 Glockl ..... A47C 3/30 297/258.1
8,888,184 B2 * 11/2014 Meyer ..... A47C 3/026 297/302.1
9,763,520 B1 * 9/2017 Pan ..... A47C 1/03255
9,861,202 B2 * 1/2018 Qi ..... A47C 3/025
9,894,998 B2 * 2/2018 Walser ..... A47C 3/029
10,034,547 B1 * 7/2018 Pan ..... A47C 3/0252
10,362,876 B2 * 7/2019 Aono ..... A47C 9/002
2011/0175414 A1 * 7/2011 Asbjornsen ..... A47C 9/002 297/313
2012/0292968 A1 11/2012 Lee
2020/0383480 A1 * 12/2020 Schroeder ..... A47C 7/14

FOREIGN PATENT DOCUMENTS

DE 202009011789 U1 12/2009
DE 202008017646 U1 4/2010
WO 0191615 A1 12/2001

OTHER PUBLICATIONS

Written Opinion of the ISA for PCT/HU2019/050057 dated Mar. 30, 2020, in English (6 pages).

* cited by examiner

CHAIR SUPPORT DEVICE PRIMARILY FOR OFFICE USE

CROSS-REFERENCE TO RELATED APPLICATIONS

This application is a U.S. national phase application filed under 35 U.S.C. § 371 of International Application No. PCT/HU2019/050057, filed Dec. 18, 2019, which designated the United States, and claims priority from Hungarian Patent Application No. P1800441, filed Dec. 21, 2018, the complete disclosures of all the applications are hereby incorporated herein by reference in their entirety.

The invention relates to a chair support device primarily for office use, in which at the weight line of the chair held thereby or close to the weight line a lower support tube is provided, and the chair support device comprises a lower support having rollers or feet standing on the floor and positioned in predetermined distances from each other, and further comprises a support member that has a central axis and receives the lower support tube and has a releasable connection with the support tube, wherein the axis of the support member falls in the extension line of the lower support tube.

It is a known fact that a seat, especially after extended sitting, imposes a load on the muscles and joints of the human body, and this can be unhealthy, and sooner or later might cause movement complaints.

When the sitting subject is not supported in a fully stable way, but the support is associated with a predetermined degree of instability which should be compensated by the sitting person even by a minimum degree of movement, or in cases where the maintaining of the sitting position forces the subject to take a healthy position, the aforementioned complaints will emerge after a long term use.

These principles have been seriously considered by the design of several types of chairs, but with time the use of all of such designs caused discomfort or lead to the appearance of other complaints.

Balls or rigid spheres are used in the utility model CN204363462 in which between the support device and the seat in concentric circles as inner rings balls are arranged, and the seat can be turned around a vertical axis relative to the stationary support device. This solution does not allow a possibility for spatial movements.

In the document WO 01/91615 the conventional rollers of an office chair were guided in an adjustable way along with displacement of a spherical track, wherein the guidance took place against a spring bias, and for the sitting subject the height of the chair changed with the weight acting on the given rollers. This solution forced the sitting subject to a permanent change of his/her position and to a permanent movement, whereas there was no proportionality between in the first hand the exerted force and the weight acting on the roller and on the other hand the direction and extent of the so created movement.

The solution to the problem has been considered by several people by using a large ball inflated by air to sit thereon, which forces the sitting subject for a continuous active movement. Although this solution is liked by a number of people, it could not become a widespread model for the general public, because its long term use was not comfortable.

There is a need therefore to a chair support device, which in addition to enabling the change of the angular position of the subject by a tilting or a smaller movement can also provide a definite and proportional support for the subject.

From the design point of view it is a rightful expectation that it should have a simple structure, does not require an increased amount of maintenance and should be comparatively cheap.

The task of the invention is to provide a chair support device that can satisfy the above-defined requirements, which can ensure a comfortable and healthy seat even after a long time of use and have a simple constructional design.

The active chair support device, according to the invention will now be described in connection with exemplary embodiments thereof in which reference will be made to the accompanying drawings. In the drawing.

Figure 1:
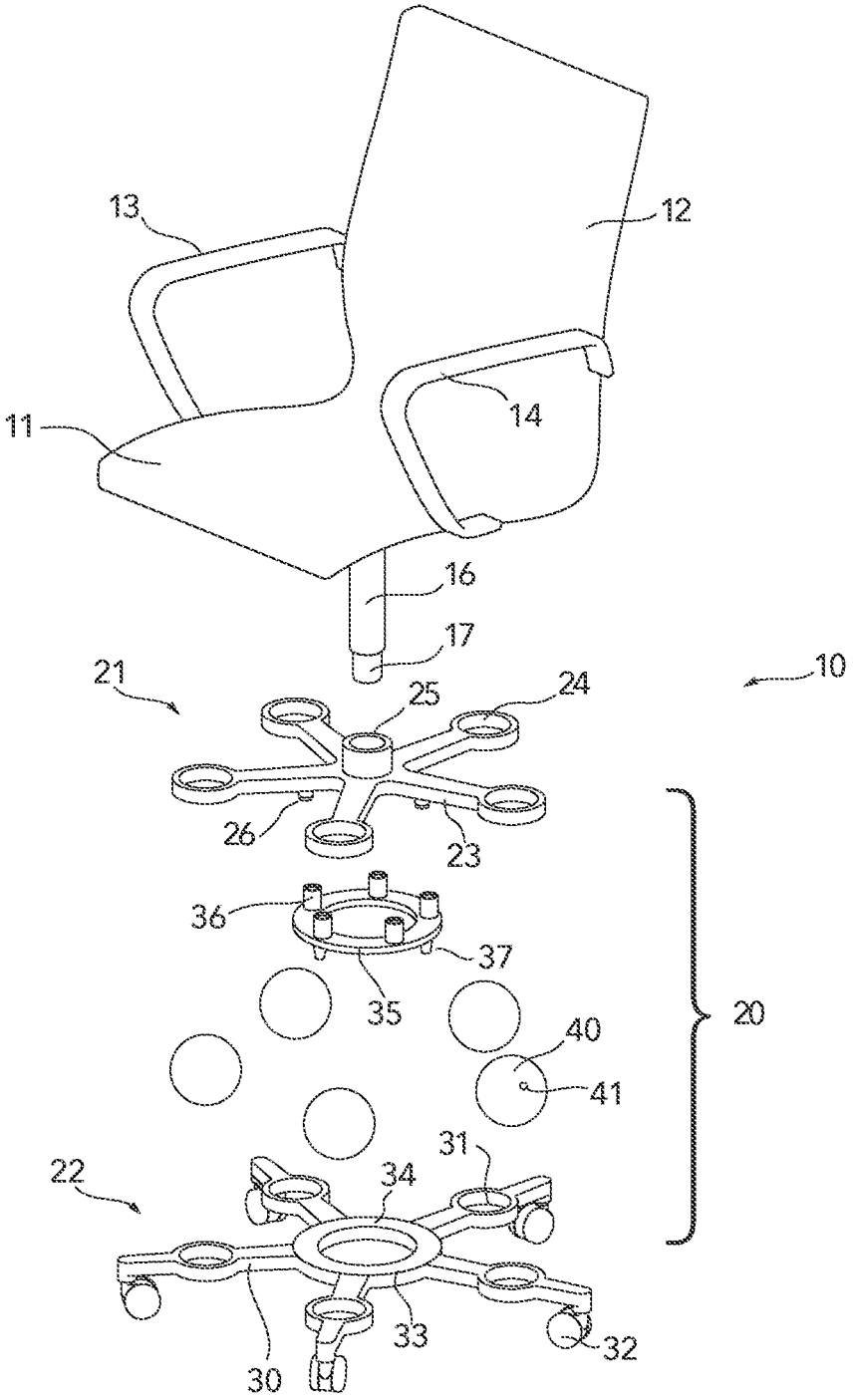
FIG. 1 shows the perspective view of the chair support device according to the invention and of a chair in exploded view.

FIG. 1 shows the exploded perspective view of the first embodiment of the chair support device 10, according to the invention. The chair support device is shown primarily for use as support for an office chair because its advantages will become most apparent at such an application, however several other applications can be made e.g. as an armchair, normal chair or a dining table chair as used in a restaurant, furthermore in conference rooms, in hotels and with slight modification as a seat in a theater or in a concert hall. The term "chair" is used therefore in a broad sense and includes all kinds of devices by which a user can obtain a resilient, active support.

The chair held by the chair support device 10 has a conventional seat 11 which can be designed in the simplest way, and in addition to a conventional height adjustment facility there is generally no need for the adjustment of the tilting angle, but the seat 11 can also be equipped with such an adjustment. The seat 11 can have a backrest 12 and in given cases a pair of armrests 13, 14 and a vertical support tube 16 arranged in the supposed weight line, wherein the support tube 16 carries the weight of the seat 11. The support tube 16 is designed conventionally and it is usually equipped with an air spring and it also enables the height adjustment. For the sake of better visualization these elements were not shown in the drawing. At the bottom of the support tube a slightly conical pipe stub 17 is arranged to have an axis 27 in line with the axis of the support tube 16.

The chair support device 10 has a support assembly 20 that comprises an upper holder 21 and a lower support 22, and both of them have five arms arranged as a regular five-sided polygon and a central part for interconnecting them. The upper holder 21 has shorter five arms 23 and at their end regions respective circular receiving openings 24 are provided. It can be preferred if the shape of the interior surface of the receiving openings 24 is designed as a spherical cap, whereby it can provide good support for an associated ball 40.

At the central part of the upper holder 21 where the five arms 23 meet, a short upright sleeve 25 is provided having an upper opening designed for receiving and fixing the downwardly projecting pipe stub 17 which can be fitted therein in a self-locking way. By such a connection the seat 11 can be positioned in a releasable way onto the upper holder 21, and in case of need another chair with a different design can also be placed on the support assembly 20.

Out of the arms 23 of the upper holder 21 from the bottom of two oppositely positioned arms 23 respective downwardly directed short distance members 26 project out which can be observed in FIG. 1. The distance members 26 have the task of providing a possibility for the transitional termination of the active effects of the chair support device 10 and to enable its use as a conventional stable support. This function will be described in more detail in a later part of the specification.

The lower support 22 also has five arms 30 which are somewhat longer than the arms 23 provided on the upper holder 21, and with centers falling in the vertical axis lines of the ball receiving openings 24 of the upper holder 21 respective lower ball receiving recesses 31 are provided that are open at their tops and have the shape of a spherical cap preferably. Close to the outer ends of the arms 30 at the bottom of the arms respective rollers 32 are provided designed as the rollers of conventional office chairs, and they enable the displacement or rolling of the lower support 22 and with it of the active chair in any direction. Naturally, instead of the rollers 32 fixed legs can also be used. Close to the interior ends the arms 31 are interconnected by a ring 33.

The essence of the invention lies substantially in the use of a number of identical balls 40 which are spheres made of elastic rubber or any other similar elastic material and provided preferably with a respective valve 41, and can be inflated to have a predetermined hardness or pressure. The diameter of the balls can be freely chosen, it is preferred if it is between about 10 and 20 cm.

The diameter of the balls 40 is greater than the outer diameter of the ball receiving openings 24 and recesses 31 (preferably by at least more than by 30%-60%). During assembly, the balls 40 are positioned from above into the respective ball receiving recesses 31 made in the arms 30 of the lower support 22. The upper holder 21 should be placed above the lower support 22 so that the top of the balls 40 be fitted in the ball receiving openings 24 of the arms 23 of the upper holder 21. The diameter of the spherical caps of the ball receiving openings 24 and recesses 31 should correspond to the diameter of the ball 40 or close to it.

Figure 2:
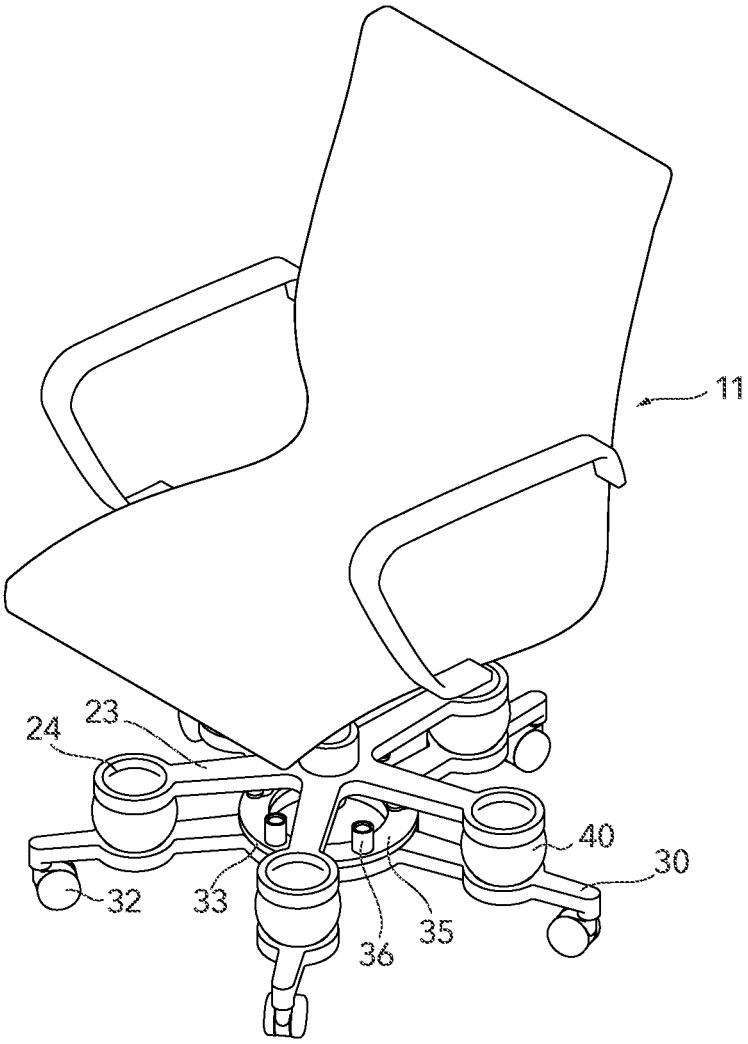
FIG. 2 is the perspective view of an embodiment of the chair support device according to the invention and of the support assembly.
Figure 3:
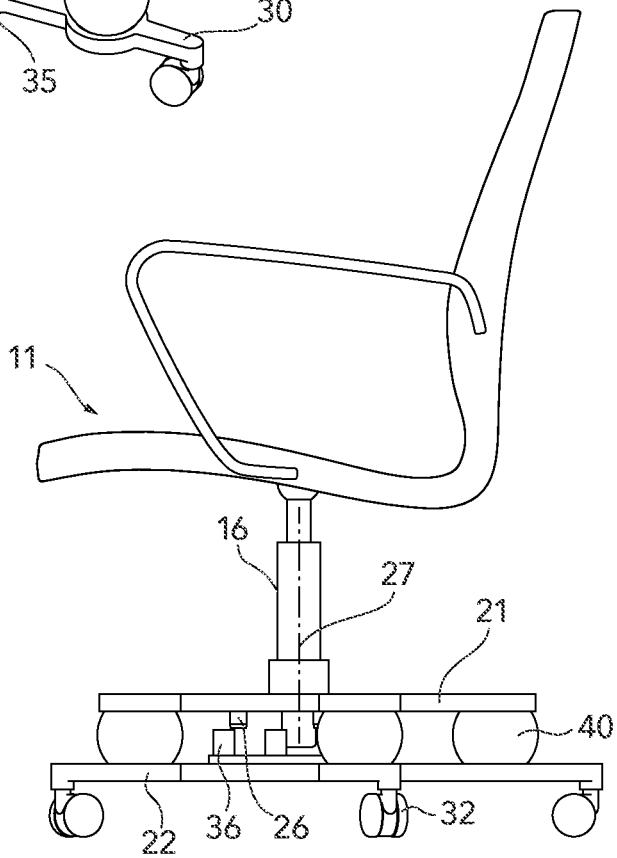
FIG. 3 shows the side view of the chair support device and supporting assembly.

Reference is made now to FIGS. 2 and 3 in which the chair support device 10 is shown in ready to use state as assembled from the parts shown in FIG. 1. In the drawing it can be observed that between the lower support 22 and the upper holder 21 mechanical connections are provided only by means of the five balls 40 which nicely fit into the upwardly open ball receiving recesses 31 and the downwardly facing ball receiving openings 24. The balls are flexible and can be compressed proportionally to the weight forces acting on them. Depending on the way how the subject sitting on the chair support device 10 positions his weight on the device i.e. what angle his weight line closes with the vertical direction, differing forces will act on the respective balls, and the surface of the seat 11 will get inclined compared to the unloaded position. Any movement of the subject and the associated change of the direction of his weight line will be associated with the corresponding change of the position of the support, therefore the support will never become the same and monotonous and thereby boring. The human body accommodates to the different supporting directions, therefore the subject sitting on the chair will actively follow the changes in his position that terminates monotony and forces the subject to exercise an active movement. During such movements the support provided by the balls always remains stable and the angular range of direction will be well within the tipping limit of the chair. The fact that in case of the support provided by the balls 40 these balls are arranged in a sufficiently great distance from the axis of the support tube 16 and in an even angular distribution will limit the maximum of the tilting angle and always ensures a stable support.

Experiments made and collected by the chair support device 10 have confirmed these effects, i.e. the stable support and the associated uninterrupted need for movement which does not allow a static load of any muscular group of the body. If the balls are pumped with higher pressures, then this influences the extent of the movement and the seat becomes "harder". Most modern pumps are equipped with a pressure meter, and it is preferred if the balls 40 are blown with such pumps and this can ensure uniform pressure in each of the balls.

The elasticity of the material of the balls 40, the applied pressure and the size of the balls 40 substantially define the stability feeling provided by the chair support device 10 and by the appropriate choice of these parameters everyone can adjust his optimum range.

Figure 5:
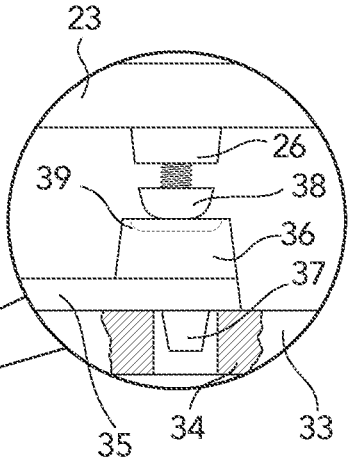
FIG. 5 shows the perspective view of the support assembly 20 in the fixed position of the chair support device.
Figure 5:
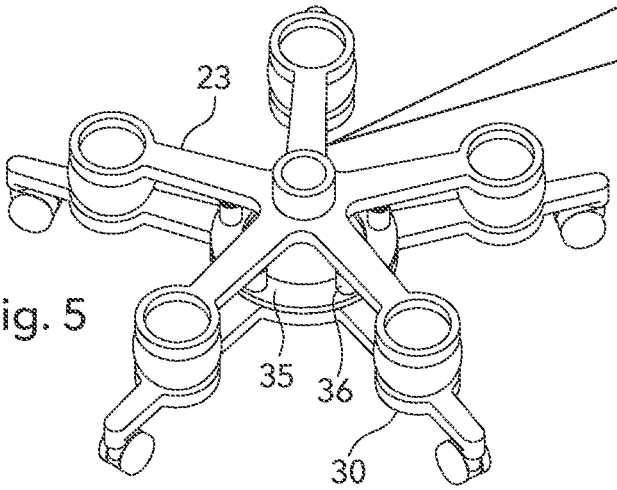
Figure 11:
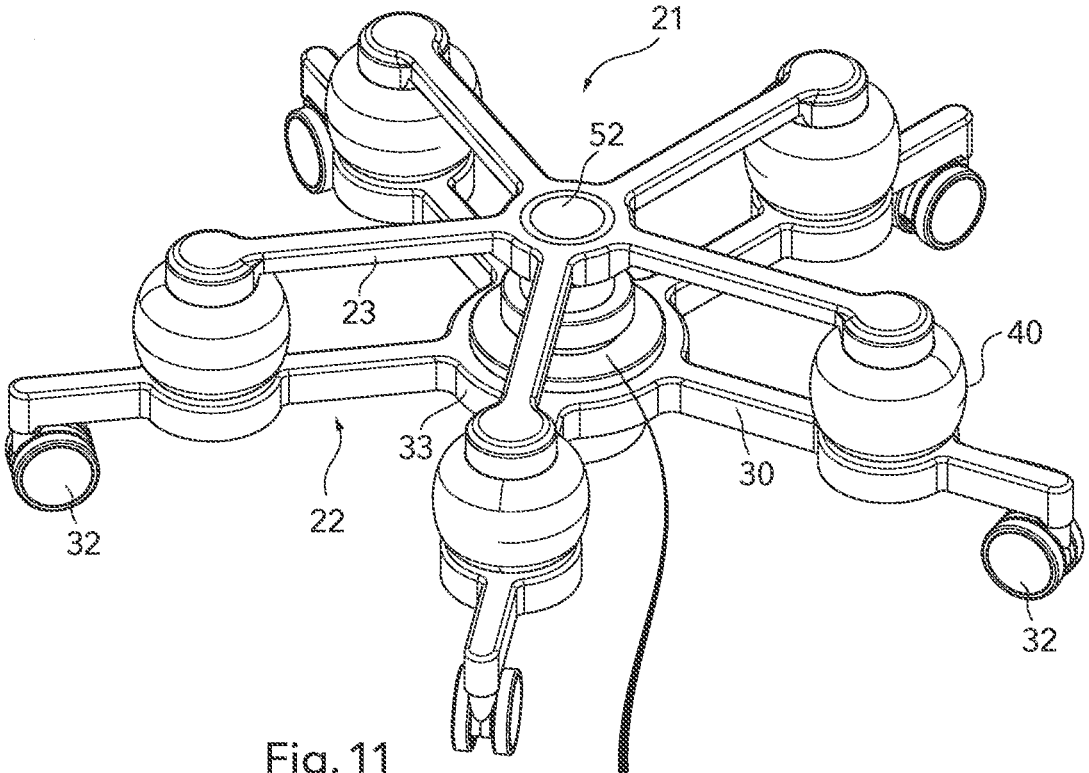
FIG. 11 shows the perspective view of a second embodiment.

In case the user wishes for any reason that the chair support device should function as a conventional non-moving chair, then this possibility can be realized in a simple way by the exemplary embodiment shown in the drawings. To this end a distance ring 35 is arranged between the upper holder 21 and the lower support 22 (see FIG. 1) from which respective projections 36 extend out in upward direction at angular positions corresponding to the corners of a regular pentagon shape which have the task of providing support for lower ends of the distance members 26 extending out in downward direction from the arms 23 of the upper holder 21 when the distance ring 35 is in an appropriate angular position. From the bottom of the distance ring 35 a pair of shafts 37 extend out in a downward direction, which have an angular distance of 144° measured along the circular arc defined by the distance ring 35, and the shafts 37 has downwardly narrowing conical shapes. The enlarged detail of FIG. 5 shows a preferred embodiment of a preferred design of these parts. The arms 23 and 30 close and angle of 72° (expressed in arc-span as 360/5=72) thus between every other one of the arms an angular distance of 144° exists.

In the enlarged detail of FIG. 5 it can be observed that from the bottom of the distance member 26 a leg 38 extends out in a downward direction which has a mushroom-like head and this fits into a similarly profiled recess 39 formed on the top of the projection 36. This connection or support is established when the distance ring 35 takes an angular position in which the distance members 26 are just opposite to the projections 36. FIG. 5 shows such a position. In this case the vertical distance between the upper holder 21 and the lower support 22 is defined by the combined height of the distance member 26 and the projection 36 (supporting it) and the added thickness of the distance ring 35. In this position the balls 40 cannot be compressed because the upper holder 21 has a fixed support that prevents any vertical displacement in a downward direction.

Figure 4:
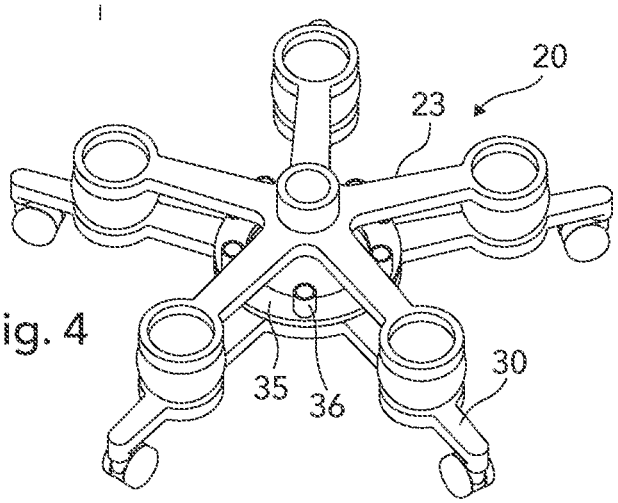
FIG. 4 shows the perspective view of the support assembly 20 in the active position of the chair support device.

The distance ring 35 can be easily moved out from the fixed position shown in FIG. 5 because the downwardly projecting two shafts 37 can be placed in two stable angular positions on the central ring 33 of the lower support 22. To this end respective pairs of positioning bores 34 are provided on the ring 33 in which the shafts 37 can be inserted, and between these bores 34 the previously mentioned angular distance of 144° is provided but the two pairs are angularly shifted from each other by 36° i.e. by a half of the angular spacing of the arms. If the distance ring 35 is placed on the ring 33 as shown in FIG. 4, then the projections 36 will be at the empty spaces between two neighboring ones of the arms 30 and 23, and in this position they cannot support the downwardly extending distance members 26, therefore the support between the upper holder 21 and the lower support 22 is provided only by the five balls 40 and the previously described chair supporting function is restored.

The change between the active and the fixed positioning can be simply carried out by the raising of the distance ring 35 and by its turning by a half angular spacing in either direction. Of course, several other designs can be provided for fixing the position by preventing the displacement between the upper holder 21 and the lower support 22 and the embodiment shown is only one of these several possible solutions.

Similarly, instead of the ball 40 a number of elastic and resilient bodies can be arranged and fixed between the arms of the upper holder 21 and the lower support 22 in a similar way as shown in FIG. 1 that can provide a limited elastic displacement being proportional to the acting load. In FIGS. 6 to 9 a number of such examples are shown.

Figure 6:
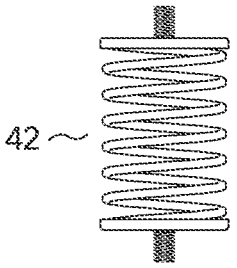
FIG. 6 shows the sketch of a spring embodiment of the elastic connection member.
Figure 7:
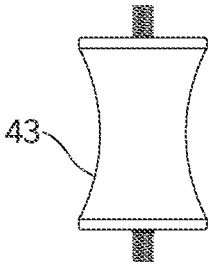
FIG. 7 shows the elevation view of an elastic block constituting the elastic connection member.
Figure 8:
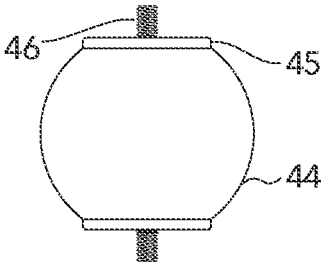
FIG. 8 shows the elevation view of a stumpy ball constituting the elastic connection member.

In FIG. 6 the elastic connecting element is constituted by a spring 42 with ends connected to the lower support 22 and the upper holder 21, respectively in a position similar to that shown in FIG. 1. The drawing shows the spring as being cylindrical but to this purpose other types of springs can also be used. FIG. 7 shows a block 43 made of an elastic material like rubber, in which the axial compression is smaller than the lateral bending, but for a given task just such a design is required. FIG. 8 shows a dumpy ball 44 that can be inflated and made by a thin elastic material, wherein both the bottom and the top have respective planar designs to which respective rigid discs 45 are coupled and they ensure the appropriate connection, and for their fixing respective threaded bolts 46 can be used. In all of these examples appropriate receiving parts should be provided on the corresponding surfaces of the lower and upper arms 23, 30.

Figure 9:
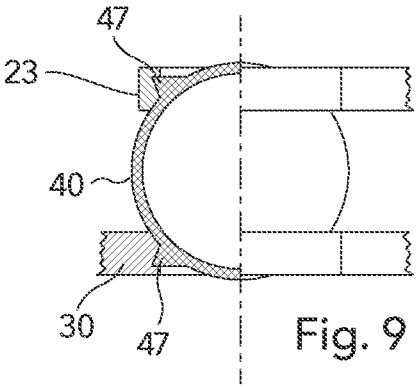
FIG. 9 is an enlarged sectional view showing the holding of the stumpy ball provided with a rim.

FIG. 9 shows a preferred profile of the ball 40 designed for this kind of use, in which the ball 40 is not completely spherical but its inflatable property has been retained. The essence lies in that at the lower and upper connections the profile has a definite projection 47 and the receiving openings and recesses 24 and 31 are provided with respective fitting profiles. The advantage of such a design lies in that owing to the form-fitting connection a stable coupling is provided between the ball 40 and the receiving openings and recesses 24, 31. Based on the examples shown, it can be realized that the elastic connection element can be designed in several other ways as shown.

Figure 10:
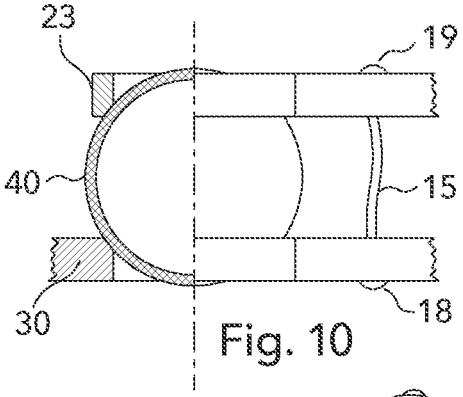
FIG. 10 shows the arrangement of ropes preventing disassembly of the upper holder and the lower support.

In the embodiments shown in the preceding part of the description for the sake of better visualization the chair support device 10 has been shown in such a way that its support assembly 20 consists of two easily separable parts i.e. between the upper holder 21 and the lower support 22 there exists no direct connection. This condition is in fact true in the operative position of the chair support device 10, whereas the chair support device 10 as a unit or a piece of furniture can be hardly moved or transported in such a way and the handling person should take care that by the raising of the upper part the lower support cannot roll away or the balls be not lost. In the sectional view of FIG. 10 a simple solution is shown that prevents such a problem to happen. The drawing is rather similar to FIG. 9 but on the portion of the arms 23 and 30 that is inward in radial direction from the position of the balls 40 respective rope sections 15 are arranged between the opposing ones of the arms 23, 30. The length of the rope sections 15 at least as long as the distance between the arms 23 and 30 when the device 10 is not loaded and their ends are lead through respective holes provided in the arms and ending at appropriate fixing heads 18, 19 (e.g. knots). The presence of these rope sections 15 prevents disassembly of the device when being raised or transported but does not affect the sinking of the upper holder 21 under load i.e. the active functioning. Out of the fixing heads 18, 19 one can be fixed i.e. being a knot, but the other one should be releasable to allow insertion or removal of the balls 40.

It should be noted that the upper holder 21 and the lower support 22 and their respective arms 23 and 40 should be designed to resist the load acting thereon and get not deformed under such loads i.e. the user should sense only the displacements caused by the compression of the balls 40.

Reference is made now to FIGS. 11 to 15 which show a further embodiment of the chair support device. In these drawings the parts that have identical roles were indicated by the same reference numerals. In the previously described embodiments it was specifically true that between the upper holder 21 and the lower support 22 only the balls 40 provided support and connection, and the central support tube 16 of the chair support device 10 was held only by the upper holder 21.

Figure 12:
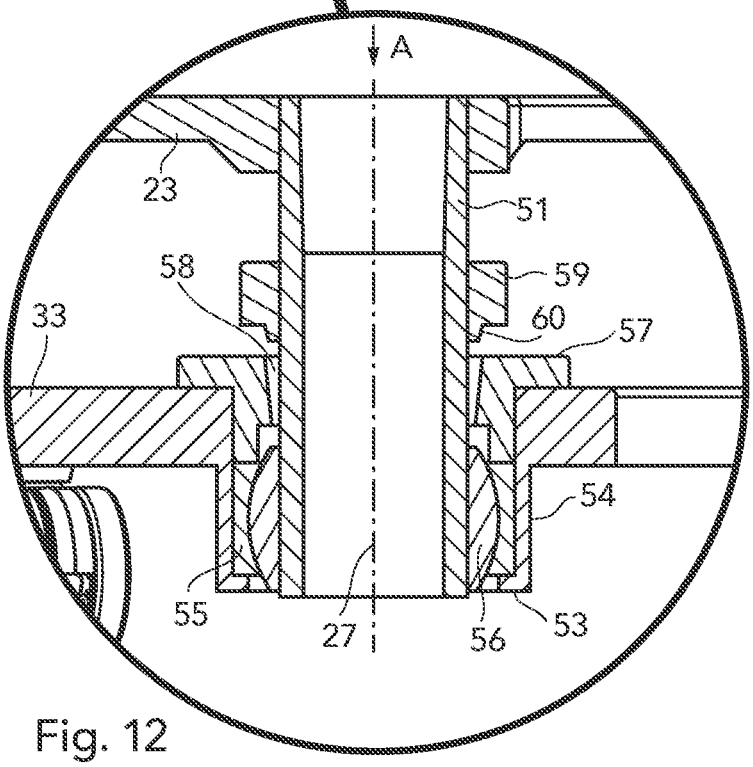
FIG. 12 shows an enlarged detail of FIG. 11 in sectional view.

In spite of that property—while maintaining the previously described active mobility and movability of the chair—in the embodiments shown in FIGS. 11 to 15 the role of the sleeve 25 shown in FIG. 1 is taken by a receiving tube 51, and in the central portion of the upper holder 21 to which the arms 23 are connected a bore 52 with a vertical axis is provided through which the receiving tube 51 is lead and to which this receiving tube 51 is also connected. In the enlarged sectional view of FIG. 12 it can be seen that the receiving tube 51 extends further in downward direction and projects till the ring 33 and slightly under it, and the receiving tube 51 is coupled through a ball joint to the central portion of the ring 33. The embodiment shown in FIG. 12 is only an example for the connection of the receiving tube 51 by a ball joint. In the middle of the ring 33 a sleeve 54 is provided which is open at the top and has a shoulder 53 at the bottom. In the cylindrical cavity of the sleeve 54 and insert 55 is arranged that has an inner cavity with spherical segment profile, and consists preferably of two half pieces. In the so formed cavity with spherical segment profile a support member 56 with matching spherical segment outer contour is positioned that has a cylindrical inner bore connected to the exterior of the lower end portion of the receiving tube 51, and this connection takes and holds the vertical component of the load acting on the receiving tube 51. The placement of the receiving tube 51 and of the support member 56 fixed to the end thereof occurs in such a way that the insert 55 that is composed of two half pieces is placed around the support member 56 when it has not yet reached the positions shown in FIG. 12 i.e. the lower end of the receiving tube 51 is not yet inserted into the sleeve 54, then the mounted assembly should be inserted into the sleeve 54 as long as its lower end abuts the shoulder 53. Above the insert 55 a limiting sleeve 57 is arranged in the central bore of the ring 33. It is preferred if the limiting sleeve 57 has an outer thread and the bore around it has a matching inner thread, and by the winding of the limiting sleeve 57 into the bore the position of the limiting sleeve 57 can be fixed. In the central portion of the limiting sleeve 57 a conical bore 58 is provided that widens in an upward direction and even the smallest lower diameter thereof is greater than the outer diameter of the receiving tube 51. Such a design provides a certain angular play for the limiting tube 51, i.e. it can be tilted from the vertical direction till abutment with the conical bore 58 in any direction. The maximum tilting angle is typically between 6° and 8% but a range between 4% and 12% provides a sufficient play. This play can be prevented by a position fixing sleeve 59 shown in FIG. 12 that has a narrow lower projection 60. The fixing sleeve 59 has preferably an inner thread and by cooperating with a matching outer thread made at the outer part of the receiving tube 51 it can be driven up and down in axial direction. In the normal position shown in FIG. 12 the fixing sleeve 59 cannot prevent the tilting of the receiving tube 51 within the permitted angular range but in case if it is wound in downward direction its projection 60 will move into the gap formed in the conical bore 58 and fixes the position of the receiving tube 51 and prevents any tilting thereof.

The connection of the seat 11 can occur by the fitting of the pipe stub 17 at the lower end of the support tube 16 into the upper end of the receiving tube 51 in the direction shown by arrow A in FIG. 12.

In this embodiment the load acting on the chair by the weight of the user will be taken predominantly through the spherically shaped support member 56 and the cooperating insert 55 by the ring 33 and the lower support 22. The position of the seat 11 is, however, not stable because the ball joint connection makes the tilting of the chair with the sitting subject possible by the angular displacement of the axis of the receiving tube 51 within the angular range permitted by the limiting sleeve 57.

The tilting of the chair is however braked down in the previously described way by the presence of the balls 40 or the elastic distance members in an elastic way. The limiting angular position should be chosen so that in such position the balls 40 will not become compressed to the permitted maximum amount but it can be not too far from the maximum.

When compared with the previous embodiment in this solution the braked tilting movement can be experienced in the same way, but the forces acting on the balls 40 are substantially smaller because the vertical component of the load will be taken by the ball joint, and this joint does not allow any displacement in radial direction between the lower support 22 and the upper holder 21.

Figure 13:
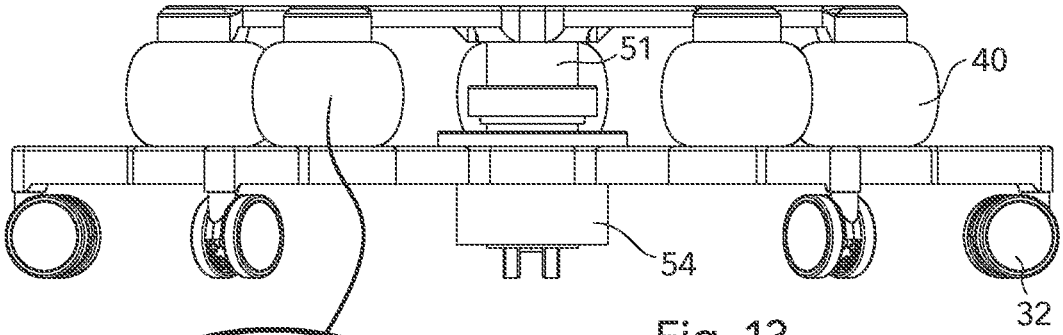
FIG. 13 shows the side view of this embodiment.
Figure 14:
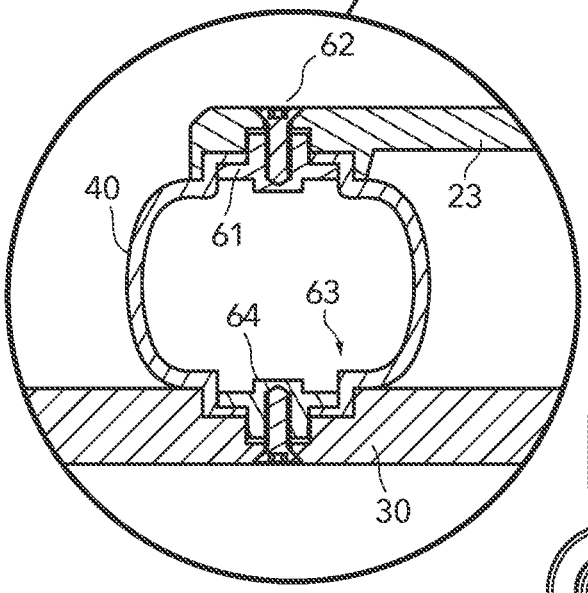
FIG. 14 is an enlarged sectional view showing the design of the ball 40.
Figure 15:
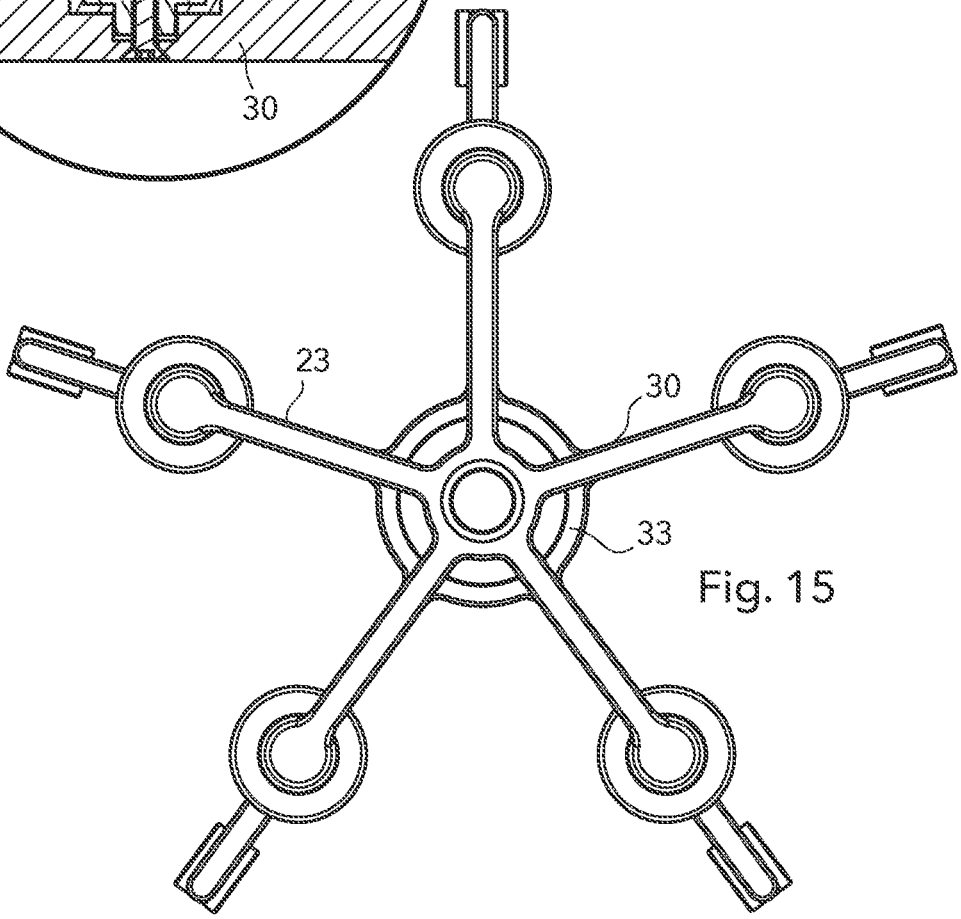
FIG. 15 is the top view of this embodiment.

Reference is made now to FIGS. 13 to 15, especially to the enlarged sectional view of FIG. 14 shows a preferred embodiment of the design of the balls 40. Although in FIGS. 6 to 9 several embodiments of the balls 40 and of the elastic connection elements useable instead of the balls were shown, the design of FIG. 14 is particularly preferred because the ball 40 (which is not very similar to a conventional ball) has respective stepped disc-like profile both at the top and bottom i.e. diametrically opposing portions. In this embodiment the balls have appropriate nests for the placement of respective inserts 61 that both have a disc-like outer part and a central part 64 provided with an inner threaded bore that project out of the disc both in downward and upward directions. Respective threaded bolts 62 can be placed in the threaded bores from the outside that provides a stable connection between the ball 40 and the upper arm 23 and at the bottom with the arm 30, respectively. The ball 40 is made of a special elastic plastic material designed to endure high loads and its stepped wall 63 on the top and the bottom can be formed in the manufacturing tool. Such a design can resist very well the load appearing when the arms 23 and 30 move closer or farther from each other, and it also resists radial displacements, by which properties the device will provide the required functions throughout a long period of time.

In the front view of FIG. 13 and in the top view of FIG. 15 it can be seen that there is a close formal similarity with the previous embodiment, the difference lies in the support at the central portion.

Figure 16:
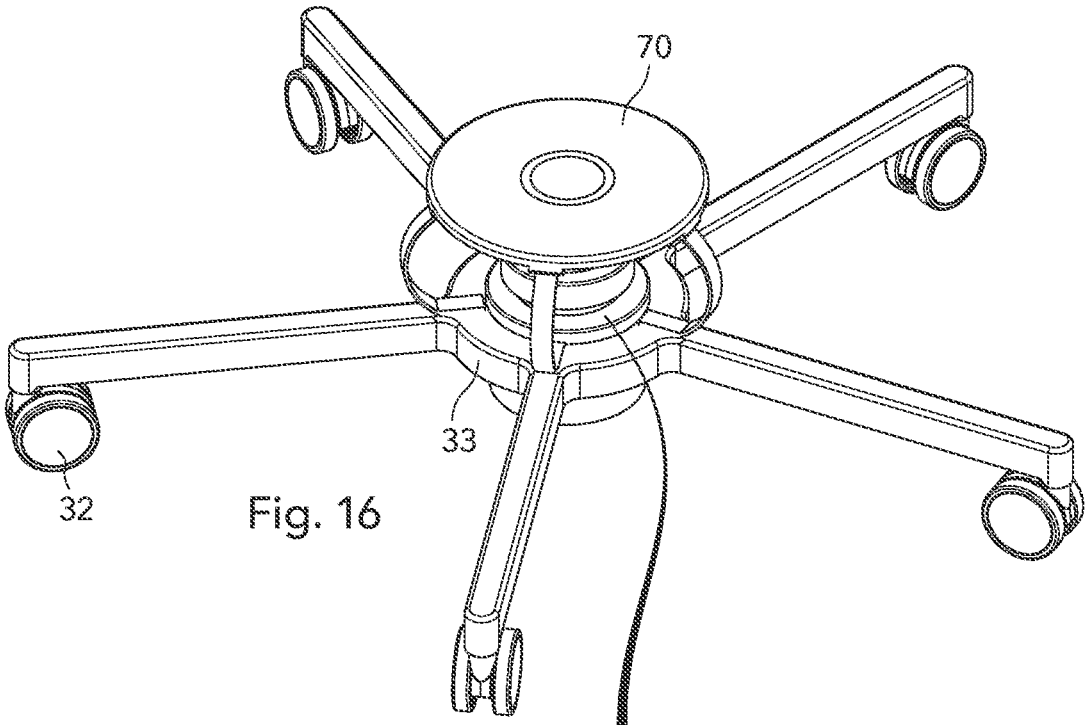
FIG. 16 shows the perspective view of a further embodiment.
Figure 17:
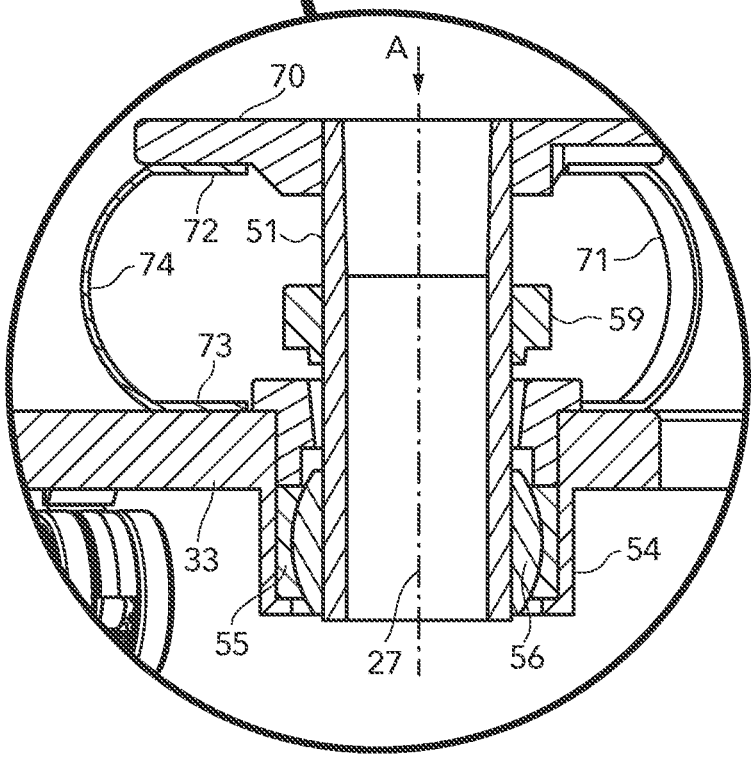
FIG. 17 is an enlarged sectional view illustrating the support of this further embodiment.

Reference is made now to FIGS. 16 and 17 in which a further embodiment of the present chair support device is shown in perspective view and in an enlarged sectional view. The most apparent difference compared to the previous embodiments lies in that here the role of the upper holder 21 has been performed by a support disc 70 which is substantially smaller than a lower support 22 with regular size. One of the reasons supporting such a design lies in that the use of a large upper holder 21 arranged at a substantial height can limit the free movement of the leg of the subject who is sitting on the chair, and this latter design might be considered by certain subjects as having a more pleasing appearance.

If for the user the same tilting possibility and sitting sensation should be provided as with the previous embodiments, then for identical tilting angles and because of the shorter radius much higher forces will act on the elastic connecting element, and a ball would not be able to endure such high loads. The forces acting on the balls 40 arranged in a great radial distance from the vertical axis will be much smaller owing to the long arms, whereas the extent of deformation will be higher. In the embodiment shown in FIGS. 16 and 17 instead of the balls the required elastic support is provided by the presence of respective C springs 71 arranged in even angular distances above the arms 30 on the lower support 22. The C spring is appropriately designed which has a curved profile with a pair of parallel upper and lower support plates 72, 73 and an arced body 74. The upper and lower support plates 72, 73 can be coupled to the adjacent planar surfaces by an adhesive or by screws and nuts. The advantage of this embodiment using C springs lies in that it does not comprise the large upper holder 21 and the balls 40 with large size, and the use of appropriately dimensioned C-springs can provide the same feeling as the embodiments using the balls.

The objective of showing the foregoing embodiments was to explain the operation and properties of the device according to the invention however, for a man skilled in the art it is apparent that a number of other embodiments can provide the same function and sensation. The number of the arms and springs can be decreased or increased thus not only the five-armed embodiments can be used, the number of the arms can be even as high as eight or ten. Minimum three arms or springs have to be used in any way and the most preferred number is the number five as shown. The use of more than ten arms can be superfluous or even disturbing.

The invention claimed is:

1. A chair support device, the chair support device comprising:

a lower support (22) having rollers (32) or feet for standing on a floor and positioned at predetermined distances from each other, a lower support tube (16), a support member that has a central axis (27) and receives the lower support tube (16) and has a releasable connection therewith, wherein the central axis (27) of the support member falls in the extension of the lower support tube (16), an upper holder (21) placed at a distance above the lower support (22), the upper holder (21) having a central portion comprising or connected with the support member, a plurality of connection members (40, 42, 43, 44, 71) arranged between the upper holder (21) and the lower support (22) and arranged at angularly spaced positions in predetermined radial distances around the support member, wherein the connection members (40, 42, 43, 44, 71) are elastically compressible against a vertical load and have respective upper portions coupled to the upper holder (21) to support the same from below, and respective bottom portions held by the lower support (22), wherein the support member can be tilted from the vertical direction in any direction in the range of at most 4° to 12°, and wherein the connection members (40, 42, 43, 44, 71) provide resistance acting against such tilting, said support member comprising a receiving tube (51) that is aligned with said central axis (27), wherein the receiving tube (51) is connected to a central part of the upper holder (21) and is extended downward therefrom to the lower support (22), and a portion of the receiving tube (51) which is adjacent the lower support (22) is coupled to a central portion of the lower support (22) by means of a ball joint that enables tilting of said receiving tube (51) within said angular range and ensures that a weight load of the chair is taken predominantly by the lower support (22).

2. The chair support device as claimed in claim 1, wherein said ball joint comprises a member (56) fixed to the exterior of the receiving tube (51) that has an outer shape of a spherical segment and an insert (55) that has a cylindrical outer shape and has an inner cavity formed as a spherical segment fitting to and receiving said spherical segment, said insert (55) is composed of at least two parts, and at the central part of the lower support (22) an upright sleeve (54) is provided that has a cylindrical cavity in which said insert (55) is placed and fitted.

3. The chair support device as claimed in claim 2, wherein a limiting sleeve (57) is inserted in said cylindrical cavity of the upright sleeve (54) above said insert (55) which has an upwardly widening central opening in which said receiving tube (51) is lead through, and wherein the degree of the tilting of said receiving tube (51) is limited by the central opening.

4. The chair support device as claimed in claim 3, wherein above the limiting sleeve (57) around said receiving tube (51) a fixing sleeve (59) is arranged that has an adjustable height and can be fixed at any adjusted position, and the fixing sleeve (59) has a lower projection (60) which can be moved in a ring shaped gap formed between the widening opening of the limiting sleeve (57) and the receiving tube (51), whereby the position of the receiving tube (51) can be fixed and its tilting can be prevented.

5. The chair support device as claimed in claim 1, wherein the connection members are constituted by balls (40) that each have respective disc-like planar lower and upper walls (63) receiving respective diametrically oppositely positioned discs as inserts (61) that have respective threaded central bores open to the outside, and into said bores respective threaded bolts (62) can be wound from the outside to connect the ball (40) at the top to the upper holder (21) and at the bottom to the lower support (22).

6. The chair support device as claimed in claim 5, wherein the balls (40) are fitted and fixed by said bolts (62) at their tops to respective downwardly facing open recesses formed close to the ends of the arms (23) of the upper holder (21) and at their bottoms in a similar way also by said bolts (62) to respective upwardly facing recesses provided on the arms (30) of the lower support (22).

7. The chair support device as claimed in claim 1, wherein the compressible members are respective springs.

8. The chair support device as claimed in claim 7, wherein the chair support device further comprises arms (30) having an inner part; and, a central ring (30), support disc (70), and lower and upper support plates (72, 73), wherein the compressible members each comprise a top region and a bottom region, wherein at their top regions and at their bottom regions are an upper and a lower support plate (72, 73) respectively, wherein the lower support plates (73) are connected to inner parts of the arms (30) or to a central ring (33) of the lower support (22) and the upper support plates (72) are connected to said support disc (70) in opposite positions compared to the fixing points of the lower support plates (73).

9. The chair support device as claimed in claim 7, wherein said springs are formed as C springs (71) that have respective arced stems wherein the radial distance of the arc from the support tube (51) increases from the two ends towards the center.

10. The chair support device as claimed in claim 1, wherein the upper holder (21) comprises a support disc (70) with a smaller radial size than that of the lower support (22), and the support tube (51) is connected thereto.

* * * * *